US008164415B2

(12) United States Patent
Tanaka et al.

(10) Patent No.: US 8,164,415 B2
(45) Date of Patent: Apr. 24, 2012

(54) PTC DEVICE

(75) Inventors: Arata Tanaka, Ryugasaki (JP); Hiroyuki Koyama, Narita (JP); Haruhisa Miyagi, Yachiyo (JP)

(73) Assignee: Tyco Electronics Japan G.K., Kawasaki-shi (JP)

( * ) Notice: Subject to any disclaimer, the term of this patent is extended or adjusted under 35 U.S.C. 154(b) by 562 days.

(21) Appl. No.: 12/084,530

(22) PCT Filed: Nov. 6, 2006

(86) PCT No.: PCT/JP2006/322092

§ 371 (c)(1), (2), (4) Date: May 12, 2009

(87) PCT Pub. No.: WO2007/052790

PCT Pub. Date: May 10, 2007

(65) Prior Publication Data

US 2009/0224865 A1 Sep. 10, 2009

(30) Foreign Application Priority Data

Nov. 7, 2005 (JP) ..... 2005-321858

(51) Int. Cl.
*H01C 7/00* (2006.01)

(52) U.S. Cl. ..... 338/22 R

(58) Field of Classification Search ..... 338/22 R
See application file for complete search history.

(56) References Cited

U.S. PATENT DOCUMENTS

| | | | | |
|---|---|---|---|---|
| 4,315,237 | A | 2/1982 | Middleman et al. | |
| 7,608,479 | B2 * | 10/2009 | Nakayama et al. | 438/106 |
| 2006/0160347 | A1 * | 7/2006 | Nakayama et al. | 438/612 |
| 2009/0224865 | A1 * | 9/2009 | Tanaka et al. | 338/25 |

FOREIGN PATENT DOCUMENTS

| | | | |
|---|---|---|---|
| JP | 3-184695 | A | 8/1991 |
| JP | 2002-175903 | A | 6/2002 |
| JP | 2002-353003 | A | 12/2002 |
| JP | 2003-77705 | A | 3/2003 |
| WO | WO-2004/100186 | A1 | 11/2004 |

OTHER PUBLICATIONS

International Search Report for International Application No. PCT/JP2006/322092, Feb. 6, 2007.

* cited by examiner

*Primary Examiner* — James Harvey

(57) ABSTRACT

There is provided a PTC device which allows compact connection as much as possible. Such PTC device includes a polymer PTC element (102) including (A) a polymer PTC component (112) an electrically conductive filler, and a polymer material; and (B) a metal electrode (104) placed on at least one surface of the polymer PTC component. Also present are a lead (106) of which at least a part is positioned on the metal electrode of the PTC element; a protective coating (108) which surrounds an exposed area of the PTC element, and a hardened solder paste which is present as a connection area (110) which electrically connects the metal electrode and said at least a part of the lead.

17 Claims, 1 Drawing Sheet

PTC DEVICE

FIELD OF THE INVENTION

The present invention relates to a PTC device comprising a PTC element, an electrical or electronic device wherein such a PTC device and other electrical component are connected, and a process for the production of such an electrical or electronic device.

BACKGROUND OF THE INVENTION

A polymer PTC element comprising a polymer PTC component which contains conductive fillers and a polymer material, and a metal electrode placed on at least one surface of the polymer PTC component is used in various electrical devices. For example, such a PTC element is used as a circuit protection device in a circuit which is used when charging a secondary battery of a cellphone.

When incorporating such polymer PTC element in an electrical device, a PTC element having a lead connected onto the metal electrode, which is supplied as a PTC device, is connected by soldering to an electrical component (for example, wiring, electrode of an electrical part, or a lead which forms a protection circuit), thereby incorporating the PTC device in the prescribed circuit to provide a prescribed function in an electrical device. (See Japanese Patent Laid-open Publication No. 2003-77705.

SUMMARY OF THE INVENTION

It is important for a so-called mobile electrical/electronic device, such as a cellphone, to have a compact size; thus, it is desirable that parts constituting such a device as well as electrical components such as a wiring connected thereto should be as compact as possible. It is also desirable that the connections between electrical components be as compact as possible.

It was concluded that, in making an electrical device having a PTC device incorporated therein as compact as possible, it is desirable to be able to connect an electrical component directly to the PTC device, i.e. to be able to connect the electrical component via an electrical connection area on a part of a lead which part is positioned immediately above the PTC component of the PTC device, and a studies were begun in order to make such direct connection possible. As the means of the direct connection, a connection using a solder material under heat, optionally in conjunction with the application of pressure, for example a connection between the lead of the PTC device and the electrical component by soldering using a flux material or with a conductive paste, as well as a welded connection between the lead and the electrical component were studied.

In particular, the direct connection of the electrical component was studied for a PTC device wherein the metal electrode of the PTC element and the lead are electrically connected by a solder connection area formed by soldering and wherein a protective coating on exposed areas of the PTC element is provided as an oxygen barrier. As a result, it has been found that the resistance of the PTC device may increase in an electrical device formed by implementing the direct connection.

After further study on the reason why the resistance increase of the PTC device is brought about, it has been contemplated that, when the direct connection is made as described above, a path linking the exterior of the PTC device and the PTC element is formed through the protective coating and/or between the protective coating and the lead, impairing the function of the protective coating as the oxygen barrier, and thereby increasing a possibility of the conductive filler of the PTC component being oxidized.

As a result of further study on the causes of such a path being formed through the protective coating, it has been concluded that: (1) there is a possibility that the solder connection area being present between the lead of the PTC device and the metal electrode of the PTC element is re-melted through the heat applied during the direct connection, causing the flux material component remaining in the solder connection area to evaporate, and the melted solder connection area is discharged externally through the protective coating by the gas generated due to the evaporation, creating a channel that remains as the path; and (2) there is a possibility that the melted solder material was exuded through the protective coating owing to the pressure applied as needed during the direct connection, and the channel remains as the path.

The conclusions described above have been theoretically deduced by the inventors based on the implementation methods for the direct connections and the results of experiments described below, and are considered to be possibilities with a sufficiently high probability. However, since it is believed that the resistance of the PTC device may increase due to a cause not based on such conclusions, the conclusions described above do not in any way restrict the technical scope of the present invention, and PTC devices, electrical device, etc., that satisfy the requirements set forth in the Claims of the present invention and accordingly brings about a effect substantially the same as or similar to that of the present invention are included in the technical scope of the present invention.

Bearing in mind the above conclusions, a PTC device that would allow the direct connection has been further studied, as a result of which it has been found that the above problem would be overcome by the following PTC device:

a PTC device, comprising:

(1) a polymer PTC element comprising:
  (A) a polymer PTC component comprising:
    (a) an electrically conductive filler, and
    (b) a polymer material; and
  (B) a metal electrode placed on at least one surface of the polymer PTC component;
(2) a lead of which at least a part is positioned on the metal electrode of the PTC element; and
(3) a protective coating which surrounds an exposed area of the PTC element, characterized by a hardened solder paste electrically connecting the metal electrode and said at least a part of the lead, i.e. the hardened solder paste being present as a connection area electrically connecting the metal electrode and said at least a part of the lead.

That is, upon the production of an electric or electronic device, particularly a compact one, an electric component is able to be directly connected to such PTC device, so that the problem of the resistance increase of the PTC device can be at least alleviated.

DETAILED DESCRIPTION OF THE INVENTION

The solder paste herein means a composition containing a hardening resin and solder powder, and hardened solder paste means that the hardening resin of such composition is in a hardened state as a result of being subjected to a condition that would harden it. Normally, the solder paste is free flowing. Therefore, the composition which contains the hardening resin and the solder powder constitutes a precursor for the above connection area.

A thermosetting resin is particularly preferred as the hardening resin. Examples of thermosetting resins that may be used are, for example, phenol resins, epoxy resins, urethane resins, and the like. Particularly preferred thermosetting resins are epoxy resins. The thermosetting resin comprises a main agent and a hardening agent (if required) to harden the main agent, and may also contain, as needed, other components, for example a hardening accelerator, etc.

When using an epoxy resin as the thermosetting resin, a bisphenol-A epoxy resin or a novolak epoxy resin or the like may be used. Other epoxy resins that can be used are brominated epoxy resins, glycidyl ester epoxy resins, glycidyl amine epoxy resins, and alicyclic epoxy resins, etc.

A polyamine or a carboxylic anhydride is preferably used as the hardening agent to harden the epoxy resin. Specifically, an amine-based hardening agent of an aromatic amine having a high hardening temperature, for example, 4,4'-diaminodiphenylsulfone, etc., may be used. Further, a carboxylic anhydride such as phthalic anhydride, tetrahydrophthalic anhydride, trimellitic anhydride, etc., may be used as the hardening agent.

A solder material in the form of particulates or other fine forms (for example flakes, foils) may be used as the solder powder. The solder material may be of any appropriate material, for example, generally-used tin-lead solder, a so-called lead-free solder (for example tin-silver-copper-based solder), etc.

As specific examples of the solder paste that can be used in the present invention, so-called solder paste containing a hardening resin, in particular a thermosetting resin, and solder powder, and commonly used in the electrical/electronic fields may be used. In addition to the above-mentioned hardening resin and solder power, the solder paste may contain, as needed, other components, for example, a solvent, a flux component for soldering (an organic acid such as rosin or a carboxylic anhydride), and the like. The carboxylic anhydride mentioned above as a hardening agent may also act as the flux component.

An example of a weight ratio between the hardening resin and the solder powder in the solder paste is in the range between 1:5 and 1:15, preferably between 1:8 and 1:10, and the solder paste that is commercially available normally presents no problem.

In the PTC device of the present invention, the individual parts constituting the PTC element (that is, the conductive filler, the polymer material and the metal electrode) and the lead may be the same as those used in a conventional PTC device. Since these are known, detailed explanations thereof are omitted. It is noted that the protective coating is also known; a thermosetting resin, for example an epoxy resin, is used for this so as to prevent oxygen accessing the PTC element from the outside of the PTC device and inhibit the oxidation of the conductive filler. The protective coating preferably surrounds (or covers) not only the exposed areas of the PTC element but also the exposed areas of the hardened solder paste. Surrounding (or covering) the exposed areas of the hardened solder paste is able to prevent oxygen from accessing the PTC element through the hardened solder paste.

It is noted that the exposed areas mean portions which would be exposed to the atmosphere around the PTC device unless the protective coating is not present. As far as the oxygen accessing is prevented, there may be a space between the protective coating and the exposed areas. Therefore, the protective coating may not be adjacent to the exposed areas, and there may be a space between them which space is insulated from the surrounding atmosphere.

In a preferred embodiment of the PTC device of the present invention, the conductive filler of the PTC element is a nickel or nickel alloy filler. An example of a particularly preferred alloy filler is an Ni—Co alloy filler. In other preferred aspect, the metal electrode of the PTC element is a metal foil, in particular a copper foil, a nickel foil, a nickel-plated copper foil, etc. In a further preferred embodiment, the lead connected to the PTC element is a nickel lead, an Ni—Fe alloy (for example the so-called 42 alloy) lead, a copper lead, a clad material (for example an Ni—Al clad material) lead, a stainless steel lead, and the like.

The present invention provides a process for the production of the PTC device according to the present invention as described above and also below, which process comprises the steps of

- supplying a solder paste on at least one metal electrode of the PTC element,
- locating the lead on an amount of the solder paste,
- hardening the solder paste so as to form the connection area which electrically connects the metal electrode and the lead, and
- covering the exposed area(s) of the PTC element with the protective coating. In this process, it is preferable that the protective coating further covers the exposed area of the connection area.

The present invention provides an electric device in which the PTC device according to the present invention and another electric component are connected, and also provides a process for the production of such electric device. That is, the process for the production of the electric device comprises the steps of supplying a connection means precursor between the lead of the PTC device according to the present invention and other electric element, and heating them while applying a pressure if required, followed by cooling so as to form the connection means between the lead of the PTC device and said other electric element. Optionally, exposed area(s) of the connection means may be surrounded by the protective coating. In another embodiment of the process for the production of the electric device according to the present invention, the lead of the PTC device according to the present invention and said other electric element may be connected by welding.

In the PTC device of the present invention, the metal electrode and said at least a part of the lead are connected by the connection area formed by the hardened solder paste. In the connection area formed by the hardened solder paste, it is believed that the solder material is distributed within the hardened resin while maintaining an electrical connection between the metal electrode and said at least a part of the lead. As a result, it is thought that the solder material, which is melted through the heat applied when connecting the PTC device to another electrical component, is restricted from its migration by the hardened resin even when the flux material evaporates, or further if pressure is applied, so that a path as described previously is difficult to form and the problem of the increased resistance of the PTC device is at least alleviated, and preferably substantially eliminated.

EXPLANATION OF THE REFERENCES

100—PTC device
102—PTC element

104—metal electrode
106, 106'—lead
108—coating
110—connection area
112—PTC component
114—main surface of PTC component
120—other lead (other electrical component)
122—solder material
124—electrode of resistance welding machine.

DETAILED DESCRIPTION OF THE DRAWINGS

Figure 1:
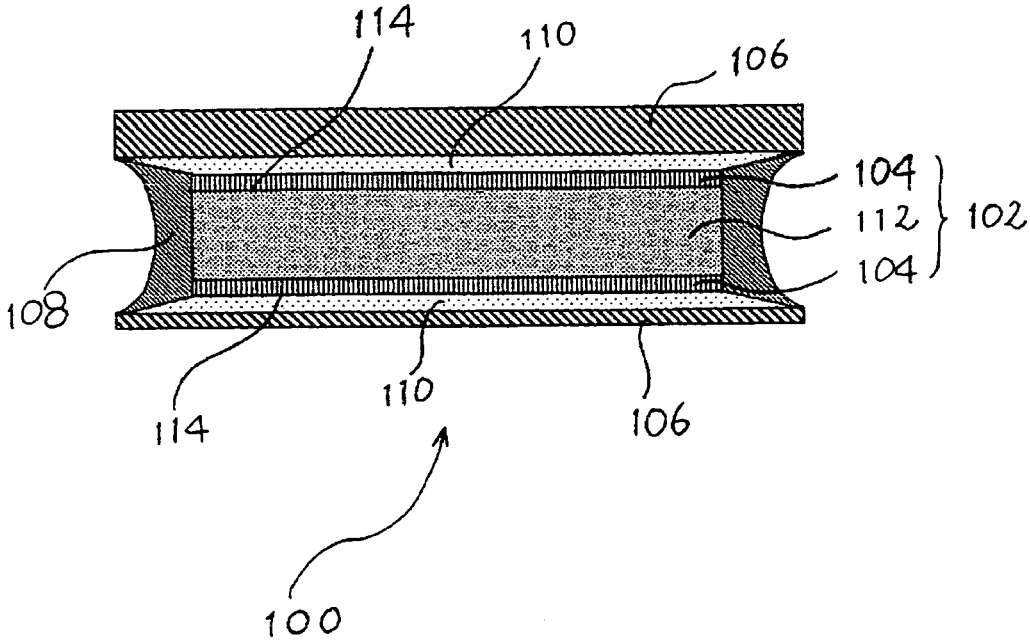
FIG. 1 shows a PTC device of the present invention in a schematic side cross-section in order to show the structure.

The PTC device according to the present invention is schematically shown in FIG. 1 as a cross-sectional side view in order to provide understanding of the constituent parts of the device. The illustrated PTC device 100 comprises a PTC element 102 and leads 106 connected to the metal electrode 104 of the PTC element 102, and the exposed areas of the PTC element 102 are covered by a protective coating 108. As can be easily understood from the embodiment shown in the Figure, a connection area 110 is present between the metal electrode 104 and the lead 106 so as to electrically connect them. This connection area 110 is composed of a hardened solder paste.

In the illustrated embodiment, substantially the entirety of the lead 106 and the substantially the entirety of the metal electrode 104 are connected by the connection area 110. In the broadest concept of the PTC device of the present invention, it is sufficient that a connection area 110 of the hardened solder paste is present in at least a portion of a space defined between the metal electrode 104 and the lead 106. In such a case, the connection area 110 may be positioned over substantially the entire upper surface of the metal electrode 104 or a portion of the upper surface of the metal electrode 104, and the lead 106 may be of a size that substantially covers the entirety of the metal electrode 104 (in some cases, it may protrude out from at least a portion of the periphery of the metal electrode 104), or of a size that covers a portion of the metal electrode 104 (in some cases, it may protrude out from at least a portion of the periphery of the metal electrode 104).

Thus, in one embodiment, a portion of the lead 106 may be connected with the entirety of the metal electrode 104. This is, for example, a case wherein the lead 106 is considerably broader than the metal electrode 104 (thus, the whole of the metal electrode is covered by a portion of the lead), or wherein the connection area is narrower than that of the illustrated embodiment (thus, the connection area is smaller than that as shown in the embodiment and the connection area is not present under a portion of the lead). In other aspect, a portion of the metal electrode 104 may be connected to the entirety or a portion of the lead 106. This is, for example, a case wherein the lead 106 is narrower than the metal electrode 104 (that is, the lead covers a portion of the metal electrode), or wherein the connection area 110 is narrower than that of the embodiment shown in the drawing.

The PTC element 102 comprises a polymer PTC component 112 and a metal electrode or metal electrodes placed on at least one surface thereof, for example on the main surfaces 114 of the two sides of the laminar polymer PTC component 112, as shown. The protective coating 108, as shown, surrounds the exposed areas of the PTC element 102 (that is, the side surfaces of the PTC element 112 and the metal electrodes 104), and preferably surrounds in addition the exposed areas of the connection area 110 (that is, an inclined side surface of the connection areas 110).

Since the PTC device of the present invention may be used for the direct connection with another electrical component, the size of the lead 106 is not necessarily larger than that of the metal electrode 104 of the PTC element, as is shown in the figure, and the entirety of the lead 106 may be present over a portion of the metal electrode 104. Needless to say, an embodiment is also possible wherein a portion of the lead 106 is positioned over the metal electrode 104 with the remaining part of the lead protruding out of the electrode.

In the embodiment shown, the entirety of the main surfaces of one of the metal electrodes 104 is connected to the entirety of the main surface of leads 106 which main surface is facing to the former main surface. In another embodiment, the entirety of a main surface of the metal electrode 104 and the entirety of the lead 106 are not necessarily connected, and a portion of one main surface may be connected to a portion or the entirety of a main surface of the other.

Figure 2:
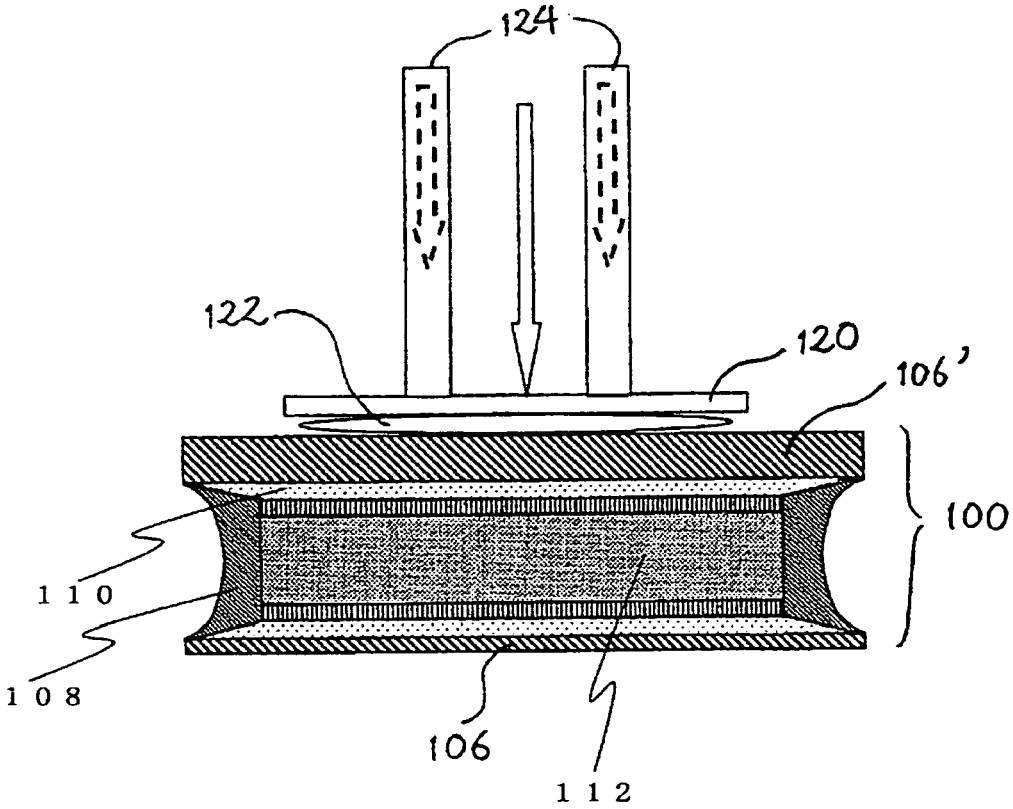
FIG. 2 shows an electrical device of the present invention produced using the PTC device of the present invention in a schematic side cross-section in order to show the structure.

FIG. 2, as in FIG. 1, shows schematically an electrical device being produced by connecting the PTC device of the present invention to another electrical component. FIG. 2 shows how a connection means is formed by placing a solder material as a connection means precursor on the lead 106' over the PTC device 100, and soldering another lead 120 as the other electrical component. For the soldering, a solder material 122 and flux material (if required) are supplied on the lead 106' and another lead 120 is placed on the top of the solder material 122. It is noted that solder paste or electrically conductive paste may be used as the connection means precursor.

The PTC device with the lead 120 placed on its top is put, for example, in a reflow oven to melt the solder material, after which the assembly is cooled to electrically connect the lead 120 to the lead 106' with the connection means 122 to obtain the electrical device of the present invention. Pressure, shown by the solid line arrow, may be applied as needed from above the other lead 120 while the solder material is melted.

In place of soldering as described above, the electrical device may be produced by welding other lead 120 to the lead 106'. In FIG. 2, other lead 120 is placed directly on the lead 106' without supplying solder material 122; resistance welding electrodes 124 are placed over the other lead 120 and the leads 106' and 120 are heated thereby and integrally welded. In this case, pressure, shown by the dotted line arrows, may be applied as needed by the resistance welding electrodes 124. It is noted that when implementing the direct connection by welding, laser welding may also be used instead of the resistance welding as described above.

Said other electrical component 120 may be any appropriate component to be electrically connected to the PTC device. Examples of other electrical components are wirings in various forms (wires, leads, etc.) or portions thereof, pads, lands, electrodes of electronic parts (chips such as semiconductor devices, resistance elements, capacitors, etc.), and the like.

With the PTC device of the present invention, the PTC component 102 and the lead 106 are prepared beforehand and solder paste is supplied between the metal electrode 104 of the PTC component and the lead 106. The supply may be implemented by any appropriate method depending on the nature of the solder paste to be used. Normally, the solder paste is placed on the metal electrode and the lead is placed over the solder paste. For example, a supply method using a dispenser, brushing, a spraying method and the like may be used to supply the solder paste.

Specifically, in one embodiment wherein the solder paste is for example close to a liquid form, the metal electrode of the PTC element may be dipped in the paste. In another embodiment, the paste may be dropped on the metal electrode, or the solder paste may be coated by an appropriate method. In a further embodiment, when the solder paste is close to a solid form, a lump or powder of a prescribed amount of the paste may be placed on the metal electrode of the PTC element.

After supplying the solder paste 110 between the metal electrode 104 and the lead 106, as described above, the hardening resin of the solder paste is hardened. When the hardening resin is thermosetting, the PTC device having the lead 106 placed thereon is heated to harden the hardening resin and at the same time melt the solder. Pressure may be applied from over the lead 106 as needed. After this, the connection area 110 is formed by cooling.

Next, a protective coating is applied around the PTC element 102 and the connection area 110. This protective coating surrounds the exposed areas of the PTC component as well as the exposed areas of the connection area 110 to prevent the oxidation of the conductive filler contained in the PTC component. It is the most preferable that the protective coating is applied to the both of the PTC element and the connection area 110. However, the protective coating applied to the connection area 110 may be omitted. The protective coating is a resin, preferably a hardening resin, in particular preferably a thermosetting resin, but it may also be a radiation hardening resin; for example, it may be a resin that hardens by irradiating ultraviolet rays, gamma rays, and the like. An example of a preferred resin is an epoxy resin and the like.

The protective coating of the PTC device may be applied by spraying a thermosetting resin. Areas which should not be sprayed are for example masked. In another embodiment, the thermosetting resin may be applied by brushing in areas where coating should be applied. The protective coatings are disclosed as oxygen barriers in for example U.S. Pat. No. 4,315,237, and the technical contents as to the oxygen barriers disclosed in this patent are incorporated as technical details of the protective coatings by reference herein.

Example 1

Production of PTC Device of the Present Invention

Solder paste (produced by Senju Metal K.K.: product name, Underfill Paste #2000) was supplied with a dispenser on one of metal electrodes of a polymer PTC element (produced by Tyco Electronics Raychem K.K.: diameter, 2.8 mm: thickness, 0.6 mm), and an Ni lead (diameter, 3.1 mm: thickness, 0.3 mm) was placed on the solder paste.

The PTC element with the lead thereon was placed in a reflow oven and heated (30-60 seconds at 220° C. or above, peak temperature was set at 260° C.) to harden the hardening resin in the solder paste as well as melt the solder powder, thereby forming the connection area between the metal electrode and the lead. After this, the exposed areas of the PTC element, sandwiched between the metal electrodes, and the exposed areas of the connection area were surrounded with an epoxy resin (produced by PPG: product name, Bairocade), which was hardened by heat to form a protective coating, thereby obtaining the PTC device of the present invention.

Details of the PTC element used are as follows:

- conductive filler (nickel filler, average particle size 2-3 μm): approximately 83 wt %
- polymer (high density polyethylene): approximately 17 wt %
- metal electrode: nickel foil (diameter 2.8 mm, thickness 25 μm)

Details of the composition of the solder paste used are as follows:

- solder powder (tin-silver-copper, melt point approximately 219° C.): approximately 79 wt %
- thermosetting resin (bisphenol-A epoxy resin, hardening condition 35 seconds at approximately 220° C. or above): approximately 9 wt %
- solvent (polyoxyalkylene ether): approximately 5 wt %
- soldering flux (organic acid): approximately 7 wt %

Production of Electrical Device of the Present Invention

Another lead (nickel, size 2.5 mm×15.5 mm, thickness 0.1 mm), as the other electrical component, was placed on the lead of the PTC device produced as described above, and the two leads were welded by pressing with a resistance welding machine (produced by Nippon Avionics, output setting 15 W), to connect them electrically and obtain an electrical device according to the present invention.

Evaluation of Resistance Change of Electrical Device

The electrical device obtained was stored in a container at 40 atms (air) so that it was subjected to the accelerated oxidation test. Resistances before testing and at 168 hours after starting the test (the resistance between the other lead 120 and the lead 106 of the PTC device on the side where the other lead was not installed (the lower lead) in FIG. 2) were measured as the resistance before test and the resistance after test. Further, the PTC element was tripped (condition: 6V/50 A/5 minutes) and the resistance after the trip was measured as the resistance after trip. Also, the initial resistance of the PTC element itself before producing the PTC device was measured in advance. Table 1 shows the resistance measurement results.

TABLE 1

| Sample No. | Initial Resistance (mΩ) | Before Test (mΩ) | After Test (mΩ) | After Trip (mΩ) |
|---|---|---|---|---|
| 1 | 3.3 | 3.7 | 3.3 | 11.2 |
| 2 | 5.8 | 6.5 | 5.9 | 24.6 |
| 3 | 5.0 | 5.6 | 5.0 | 15.0 |
| 4 | 5.2 | 5.8 | 5.5 | 34.5 |
| 5 | 5.8 | 6.4 | 5.8 | 27.4 |
| 6 | 3.5 | 3.9 | 3.5 | 10.0 |
| Average | 4.8 | 5.3 | 4.8 | 20.5 |
| Standard Deviation | 1.0 | 1.1 | 1.1 | 9.0 |
| Minimum | 3.3 | 3.7 | 3.3 | 10.0 |
| Maximum | 5.8 | 6.5 | 5.9 | 34.5 |

Example 2

A PTC device was produced in the same way as in Example 1 except that a rectangular chip-form PTC element (produced by Tyco Electronics Raychem K.K., size: 2.6 mm×4.3 mm, thickness: 0.6 mm) was used, and an Ni lead having a size of 3 mm×4.7 mm, and a thickness of 0.2 mm, to be connected to the metal electrode of the PTC element was used, and an electrical device was produced by using the PTC device. As in the previous example, the resistance values were measured. Table 2 shows the results.

TABLE 2

| Sample No. | Initial Resistance (mΩ) | Before Test (mΩ) | After Test (mΩ) | After Trip (mΩ) |
|---|---|---|---|---|
| 1 | 3.5 | 3.9 | 3.2 | 10.2 |
| 2 | 3.1 | 3.4 | 3.0 | 22.1 |
| 3 | 4.0 | 4.4 | 3.8 | 19.7 |

TABLE 2-continued

| Sample No. | Initial Resistance (mΩ) | Before Test (mΩ) | After Test (mΩ) | After Trip (mΩ) |
|---|---|---|---|---|
| 4 | 3.5 | 3.9 | 3.2 | 12.4 |
| 5 | 2.9 | 3.4 | 2.6 | 7.0 |
| 6 | 4.4 | 4.8 | 4.0 | 11.2 |
| Average | 3.6 | 4.0 | 3.3 | 13.8 |
| Standard Deviation | 0.5 | 0.5 | 0.5 | 5.3 |
| Minimum | 2.9 | 3.4 | 2.6 | 7.0 |
| Maximum | 4.4 | 4.8 | 4.0 | 22.1 |

Comparative Example 1

An Ni lead (diameter 3.1 mm, thickness 0.3 mm) was soldered to a PTC element which was the same as that of Example 1 to obtain a PTC device. For soldering, a mixture of a lead-free solder material, substantially the same as the solder powder of the solder paste in Example 1 and rosin was used, and a PTC device was obtained by forming a connection area between the metal electrode and the lead in the reflow oven. The temperature condition of the reflow oven was the same as that of Example 1 described above.

Next, another lead was soldered, in the same way as in Example 1, to the lead of the PTC device thus obtained. The output setting of the resistance welding machine was 7 W. The resistance values were measured in the same way as in the foregoing. Table 3 shows the results of the measurement.

TABLE 3

| Sample No. | Initial Resistance (mΩ) | Before Test (mΩ) | After Test (mΩ) | After Trip (mΩ) |
|---|---|---|---|---|
| 1 | 7.2 | 8.0 | 8.3 | 30.5 |
| 2 | 7.9 | 7.8 | 7.5 | 20.0 |
| 3 | 9.9 | 9.8 | 9.3 | 27.6 |
| 4 | 10.4 | 10.6 | 9.3 | 21.5 |
| 5 | 8.7 | 9.2 | 9.5 | 56.5 |
| 6 | 6.5 | 6.7 | 6.7 | 30.7 |
| 7 | 10.3 | 10.4 | 9.9 | 32.7 |
| 8 | 6.8 | 6.7 | 6.9 | 13.4 |
| 9 | 7.0 | 7.3 | 7.2 | 38.1 |
| 10 | 7.0 | 7.2 | 6.8 | 14.2 |
| 11 | 8.9 | 9.0 | 8.0 | 21.1 |
| 12 | 8.6 | 8.8 | 7.7 | 17.4 |
| 13 | 10.1 | 10.2 | 11.1 | 38.5 |
| 14 | 8.7 | 9.0 | 9.0 | 59.3 |
| 15 | 7.7 | 7.7 | 11.3 | 14.6 |
| Average | 8.4 | 8.6 | 8.6 | 29.1 |
| Standard Deviation | 1.35 | 1.32 | 1.50 | 14.32 |
| Minimum | 6.5 | 6.7 | 6.7 | 13.4 |
| Maximum | 10.4 | 10.6 | 11.3 | 59.3 |

Comparative Example 2

Other than making the output setting of the resistance welding machine 10 W when making the electrical device, Comparative Example 1 was repeated. The resistance values were measured as in the foregoing. Table 4 shows the results of the measurement.

TABLE 4

| Sample No. | Initial Resistance (mΩ) | Before Test (mΩ) | After Test (mΩ) | After Trip (mΩ) |
|---|---|---|---|---|
| 1 | 9.3 | 9.4 | 12.9 | 70.9 |
| 2 | 6.8 | 6.7 | 15.7 | 82.2 |
| 3 | 5.9 | 5.8 | 19.0 | 105.3 |
| 4 | 8.4 | 8.8 | 17.6 | 77.4 |
| 5 | 9.1 | 8.9 | 12.3 | 58.0 |
| 6 | 8.4 | 8.4 | 14.2 | 68.2 |
| 7 | 7.8 | 8.0 | 14.9 | 54.3 |
| 8 | 9.2 | 9.3 | 14.0 | 67.6 |
| 9 | 6.1 | 6.3 | 12.1 | 56.9 |
| 10 | 7.9 | 8.4 | 18.5 | 96.4 |
| 11 | 8.0 | 8.2 | 16.4 | 88.7 |
| 12 | 5.2 | 5.1 | 11.4 | 50.5 |
| 13 | 6.4 | 6.6 | 13.8 | 65.6 |
| 14 | 10.8 | 10.8 | 17.7 | 81.8 |
| 15 | 5.5 | 6.0 | 17.5 | 69.7 |
| Average | 7.7 | 7.8 | 15.2 | 72.9 |
| Standard Deviation | 1.6 | 1.6 | 2.5 | 15.8 |
| Minimum | 5.2 | 5.1 | 11.4 | 50.5 |
| Maximum | 10.8 | 10.8 | 19.0 | 105.3 |

Comparative Example 3

A Ni lead (thickness 0.2 mm) was soldered to a PTC element which was the same as that of Example 2 to obtain a PTC device. Soldering was implemented in the same way as Comparative Example 1. Next, in the same way as in Example 2, another lead was soldered to the lead of the PTC device thus obtained. The output setting of the resistance welding machine was 7 W. The resistance values were measured as in the foregoing. Table 5 shows the results of the measurement. Only the resistance after test and the resistance after trip were measured.

TABLE 5

| Sample No. | Resistance After Test (mΩ) | Resistance After Trip (mΩ) |
|---|---|---|
| 1 | 5.5 | 8.8 |
| 2 | 4.2 | 9.1 |
| 3 | 4.9 | 13.2 |
| 4 | 5.2 | 19.3 |
| 5 | 5.2 | 16.9 |
| 6 | 5.6 | 13.9 |
| 7 | 4.7 | 9.2 |
| 8 | 5.2 | 9.7 |
| 9 | 5.6 | 44.7 |
| 10 | 6.1 | 35.4 |
| Average | 5.2 | 18.0 |
| Std Deviation | 0.5 | 12.3 |
| Minimum | 4.2 | 8.8 |
| Maximum | 6.1 | 44.7 |

Comparative Example 4

Other than making the output setting of the resistance welding machine 10 W when making the electrical device, Comparative Example 3 was repeated. The resistance values were measured as in the foregoing. Table 6 shows the results of the measurement.

TABLE 6

| Sample No. | Resistance After Test (mΩ) | Resistance After Trip (mΩ) |
|---|---|---|
| 1 | 5.2 | 15.4 |
| 2 | 5.7 | 54.9 |
| 3 | 5.8 | 12.8 |
| 4 | 5.6 | 16.3 |
| 5 | 5.5 | 14.2 |
| 6 | 5.5 | 13.1 |
| 7 | 6.1 | 92.0 |
| 8 | 6.6 | 31.2 |
| 9 | 6.5 | 75.8 |
| 10 | 6.2 | 20.5 |
| Average | 5.9 | 34.6 |
| Std Deviation | 0.5 | 29.2 |
| Minimum | 5.2 | 12.8 |
| Maximum | 6.6 | 92.0 |

As is clear from the measurement results of the above Examples and Comparative Examples, with the PTC device of Example 1, the maximum values of the resistance after test and the resistance after trip are considerably smaller than those of Comparative Examples 1 and 2, which used the leads having the same thickness (0.3 mm). In other words, when using the PTC device of the present invention, it is supposed that the probability of a path being formed in the protective coating as explained previously has been greatly reduced.

Further, the output setting of the resistance welding machine used to produce the electrical device of Example 1 was 15 W, and this output setting is considerably higher than the output settings in Comparative Examples 1 and 2 (7 W and 10 W, respectively). In other words, the welding in Example 1 has a considerably larger thermal effect, compared with Comparative Examples 1 and 2, on the connection area between the metal electrode of the PTC device and the lead; in this respect, a path is apt to be more easily formed in the protective coating in the PTC device of Example 1. The fact that, in spite of this, the measurement results of the resistance values in Example 1 illustrates the fact that, based on the present invention, paths are not easily formed in the protective coating of the PTC device.

A trend similar to the results of Example 1 and Comparative Examples 1 and 2 can be seen in the measurement results of Example 2 and Comparative Examples 3 and 4.

The PTC device of the present invention can be incorporated in an electrical device by the direct connection, as a result of which the electrical device may be made compact, while at the same time the possibility of the resistance increase of the PTC element is greatly reduced, so that the reliability of the circuit in which the PTC element is incorporated is enhanced.

The invention described above, which uses the solder paste in producing the PTC device, is also useful for PTC devices using carbon black as the conductive filler and not having protective coating. In other words, since using the solder paste provides the effect(s) described above, when connecting other lead, by heating, to a PTC device wherein the metal electrode of the PTC element and the lead are connected by the connection area of the solder material, in particular when connecting while applying pressure, the problem of the possibility of the solder material between the metal electrode and the lead being exuded from the connection area (the problem that, as a result, the conductivity of the connection area may become insufficient) is resolved.

Such a PTC device is characterized by the conductive filler comprising carbon black, and the protective coating being omitted in the PTC device of the present invention. An electrical device may be similarly produced using such a PTC device in the production process for the electrical device described above. However, a protective coating is not required.

What is claimed is:

1. A PTC device, comprising:

(1) a PTC element comprising:

(A) a polymer PTC component comprising:

(a) an electrically conductive filler, and (b) a polymer material; and (B) a metal electrode placed on at least one surface of the polymer PTC component;

(2) a lead of which at least a part is positioned on the metal electrode of the PTC element; and (3) a protective coating which surrounds an exposed area of the PTC element, characterized by a hardened solder paste electrically connecting the metal electrode and said at least a part of the lead, said solder paste comprising a hardening resin and solder powder.

2. The PTC device according to claim 1, wherein the lead is placed in its entirety on the metal electrode.

3. The PTC device according to claim 1, wherein the solder paste comprises a thermosetting resin and solder particles.

4. The PTC device according to claim 1, wherein the hardening resin is an epoxy resin.

5. The PTC device according to claim 1, wherein the conductive filler is Ni filler or Ni alloy filler.

6. The PTC device according to claim 5, wherein the Ni alloy is a Ni—Co alloy.

7. The PTC device according claim 1, wherein the lead is a Ni lead.

8. The PTC device according to claim 1, wherein the protective coating is formed of a hardened thermosetting resin.

9. An electrical device comprising:

(I) a PTC device, comprising:

(1) a PTC element comprising:

(A) a polymer PTC component comprising:

(a) an electrically conductive filler, and (b) a polymer material; and (B) a metal electrode placed on at least one surface of the polymer PTC component;

(2) a lead of which at least a part is positioned on the metal electrode of the PTC element;

(3) a protective coating which surrounds an exposed area of the PTC element, and (4) a hardened solder paste electrically connecting the metal electrode and said at least a part of the lead, said solder paste comprising a hardening resin and solder powder; and (II) an electrical component electrically connected to said PTC device.

10. The electrical device according to claim 9, wherein the PTC device and the electrical component are electrically connected by a connection means positioned between the lead of the PTC device and the electrical component which is positioned over the lead.

11. The electrical device according to claim 10, wherein the connection means positioned between the lead of the PTC device and the electrical component is formed by heating a connection means precursor.

12. The electrical device according to claim 11, wherein the connection means precursor is a solder material, a solder paste, or an electrically conductive paste positioned between the lead and the electrical component.

13. A PTC device according to claim 1, wherein the conductive filler is composed of carbon black.

14. The electrical device according to claim 9, wherein the electrical component is a wiring, a pad, or a land, a portion thereof, or an electrode of an electronic part.

15. The electrical device according to claim 9, wherein the lead of the PTC device and the electrical component positioned over the lead are electrically connected directly by a weld.

16. A process for producing a PTC device, said PTC device comprising:

(1) a PTC element comprising:

(A) a polymer PTC component comprising:

(a) an electrically conductive filler, and (b) a polymer material; and (B) a metal electrode placed on at least one surface of the polymer PTC component;

(2) a lead of which at least a part is positioned on the metal electrode of the PTC element;

(3) a protective coating which surrounds an exposed area of the PTC element, and (4) a solder paste comprising a hardening resin and solder powder;

said process comprising supplying a solder paste on at least one metal electrode of the PTC element, locating the lead on an amount of the solder paste, hardening the solder paste so as to form a connection area which electrically connects the metal electrode and at least part of the lead, and covering the exposed area of the PTC element with the protective coating.

17. The process according to claim 16, wherein the protective coating covers the exposed area of the connection area in addition to the exposed area of the PTC element.

* * * * *